United States Patent [19]

Fixemer et al.

[11] Patent Number: 4,616,200

[45] Date of Patent: Oct. 7, 1986

[54] CIRCUIT BREAKER

[75] Inventors: James V. Fixemer, Denton, Nebr.; Neil R. Palmer, Swisher, Iowa; Charles H. Wagner, Lincoln, Nebr.; John M. Winter, Cedar Rapids, Iowa

[73] Assignee: Square D Company, Palatine, Ill.

[21] Appl. No.: 649,784

[22] Filed: Sep. 12, 1984

[51] Int. Cl.[4] ..... H01A 75/12

[52] U.S. Cl. ..... 335/35; 335/172; 335/202

[58] Field of Search ..... 335/23, 35, 36, 38, 335/167, 172, 173, 174, 202

[56] References Cited

U.S. PATENT DOCUMENTS 3,401,363 9/1968 Vyskocil et al. ..... 335/35 X
3,760,308 9/1973 Misencik et al. ..... 335/35
4,417,222 11/1983 Schmitt et al. ..... 335/35 X

FOREIGN PATENT DOCUMENTS 1400155 7/1975 United Kingdom ..... 335/35

*Primary Examiner*—George Harris
*Attorney, Agent, or Firm*—Larry I. Golden; Richard T. Guttman

[57] ABSTRACT

An automatic electric side-by-side two-pole circuit breaker having an insulating casing formed from the complementary association of a base casing, an intermediate casing and a cover which provide a pair of mechanism receiving compartments in side-by-side association. Each compartment carries a pivotally supported operating handle which extends partially outward from the casing for external manual operation, a line terminal, a load terminal electrically connected to said line terminal, a stationary contact intermediate said line terminal and said load terminal and a movable blade which carries a movable contact on one end and has its opposite end connected to the handle. A releasably latched generally thin trip lever is pivotally mounted within the compartment and is releasable from its latched position to a tripped position to effect separation of the contacts. The trip lever includes an upstanding leg which is engaged by a protuberance on the handle for resetting the trip lever. The handle overlaps the trip lever as does the movable contact blade which has an extending top segment received in a recess of the handle for operation of the movable blade by the handle. A spring is connected between the generally J-shaped blade and the trip lever for snap action of the blade.

24 Claims, 12 Drawing Figures

CIRCUIT BREAKER

BACKGROUND OF THE INVENTION

1. Field of the Invention

This invention relates to apparatus for making and breaking electrical circuits, and particularly to a readily assembled, space efficient branch circuit breaker automatically operable in response to current overloads.

2. Description of the Prior Art and Summary of the Invention

Molded case automatic circuit breakers which are removably mounted in electrical panelboards are commonly used to control branch circuits in residential and commercial applications. Representative circuit breakers are disclosed by U.S. Pat. Nos. 3,098,136, 3,109,907 and 3,443,258 which are assigned to the same assignee as the instant invention and are hereby incorporated by reference. The '907 patent discloses a two pole circuit breaker having separate operating mechanisms which control independent branch circuits and which occupy substantially the same space as the single pole mechanism disclosed in either of the other two patents. In accordance with the instant invention, there is provided a two pole circuit breaker having the poles in side by side or stacked relationship as opposed to end to end relationship as in the '907 patent. A substantial reduction in width of each of the poles requires particular attention to component design to assure adequate mechanical strength and proper current carrying capacity while maintaining appropriate electrical clearances to enable the circuit breaker to operate properly.

An object of the present invention is to provide an improved circuit breaker which is of simple and economic construction.

A further object of the present invention is to facilitate automated assembly of the circuit breaker.

A further object of the present invention is to provide a side-by-side, stacked, two-pole circuit breaker having a width of substantially $\frac{3}{8}$ inch per pole and overall enclosure width of approximately $\frac{3}{4}$ inch.

A further object of the present invention is to provide an improved and economical bimetal assembly.

A further object of the present invention is to provide an improved multi-function trip lever.

A further object of the present invention is to provide an improved and more economical arc shield which is integral with the circuit breaker casing.

A further object of the present invention is to provide an improved movable contact blade requiring a minimum of scrap during formation of the blade.

A further object of the present invention is to provide a single jaw having two line side contacts connected thereto which allows two breaker poles to share a single jaw of the same polarity.

A further object of the present invention is to provide an improved low current magnetic trip assembly.

Further objects and features of the invention will be readily apparent to those skilled in the art from the following specification including the appended claims and the accompanying drawings of the invention in which:

DESCRIPTION OF THE PREFERRED EMBODIMENT

Figure 1:
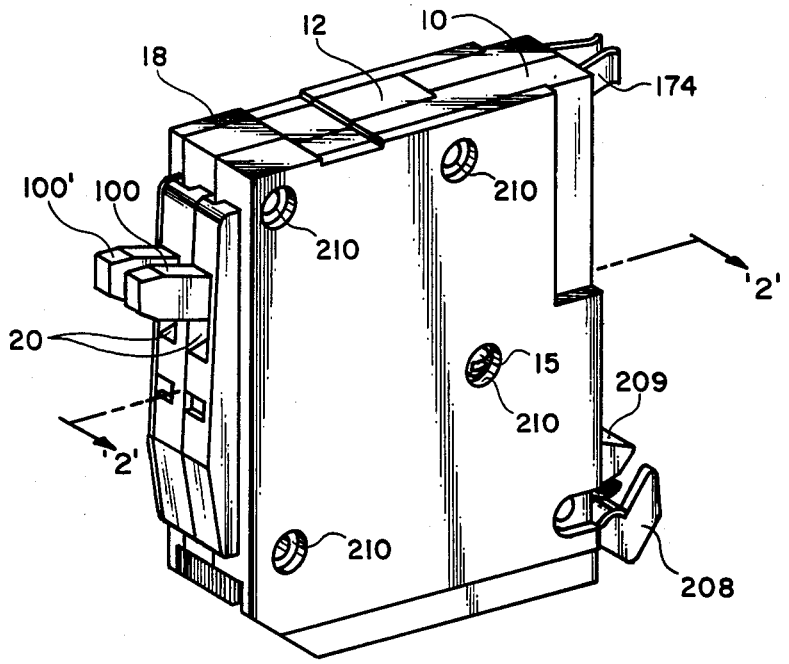
FIG. 1 is a perspective view of the two-pole circuit breaker fully assembled.

The circuit breaker of the present invention includes an open sided base casing 10 of molded insulating material such as a polyester glass having molded recesses and barriers for receipt of a circuit breaker mechanism therein. An intermediate casing or base cover 12 of similarly molded insulating material is provided having a first side 14 adapted to be complementarily received against the open side of base 10 and a second side 16 having molded recesses and barriers similar to those in the casing 10 for receipt of a separate circuit breaker mechanism therein. A cover casing 18 is also provided which has complementary recesses and barriers that are received against the second side 16 of intermediate casing 12 to close the side-by-side two-pole circuit breaker as shown assembled in FIG. 1. When the three casings are complementarily associated and connected by fasteners 15 through openings 210, top openings 20 and bottom openings 22 and 24 are provided through which the operating and connecting members of the circuit breaker mechanism extend as will be hereinafter described. Opening 26 is also provided at the bottom of the casing to facilitate venting of arc gases.

Figure 2:
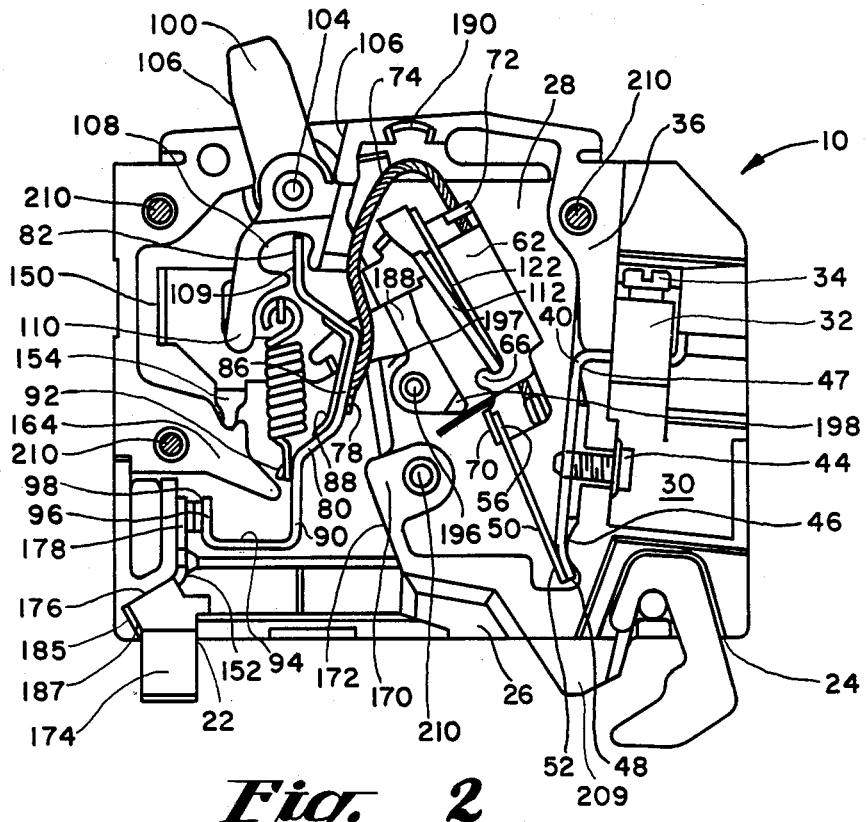
FIG. 2 is a side view taken generally along lines 2—2 showing the mechanism in a contact closed position within the base of the circuit breaker.
Figure 6A:
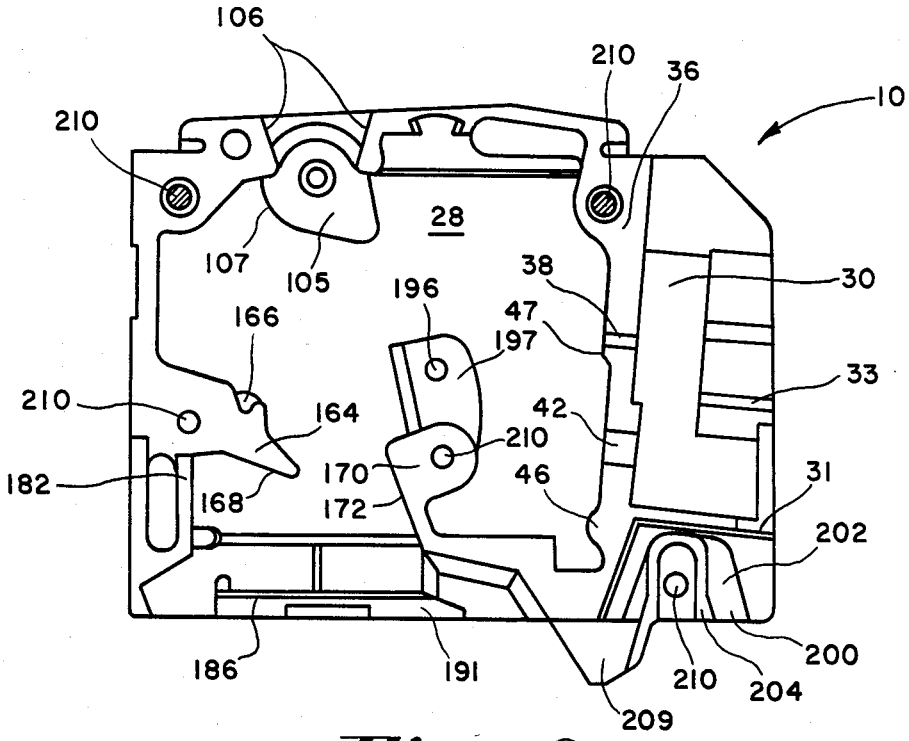
FIG. 6*a* shows the inner side of the base of the circuit breaker.
Figure 6B:
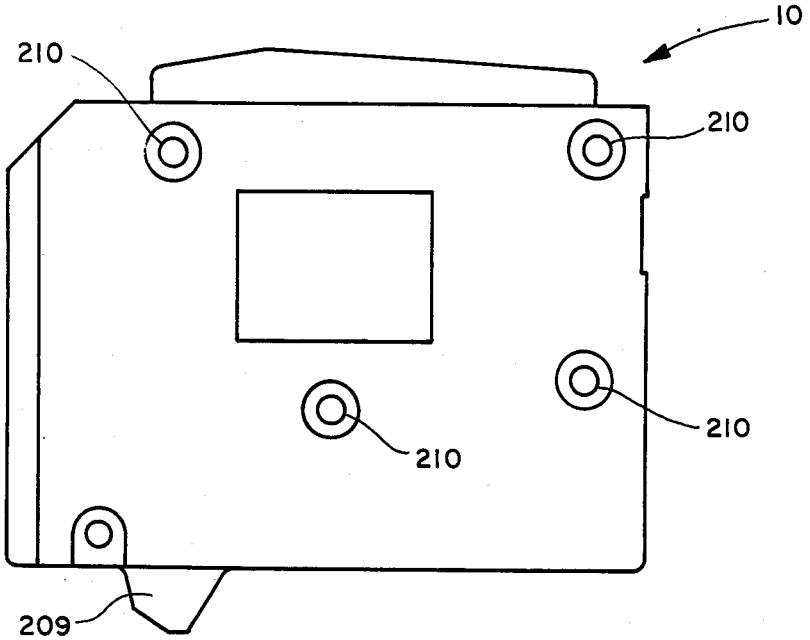
FIG. 6*b* shows the outer side of the base of the circuit breaker.
Figure 7A:
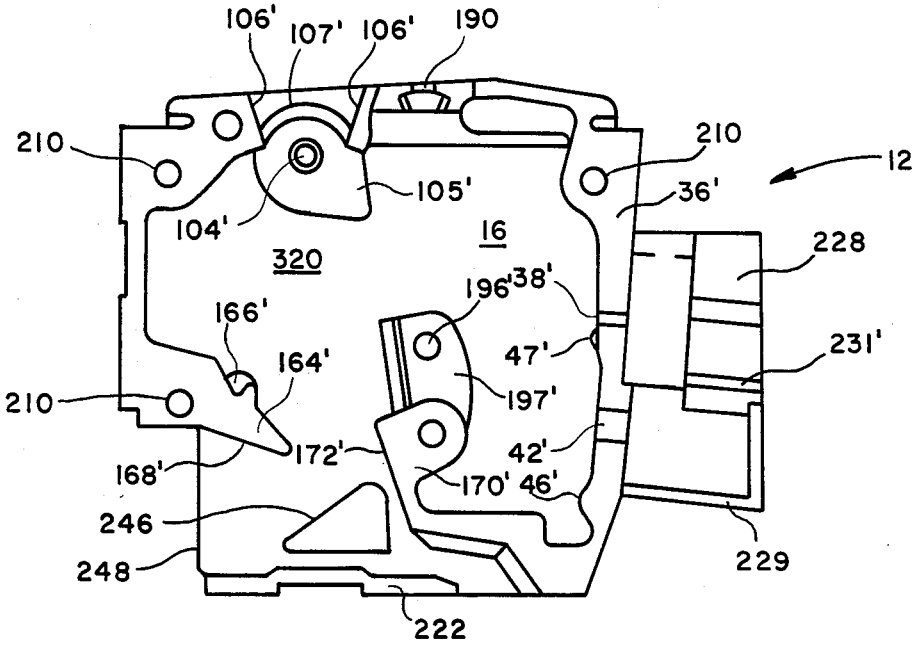
FIG. 7*a* shows the mechanism receiving side of the intermediate casing of the circuit breaker.
Figure 7B:
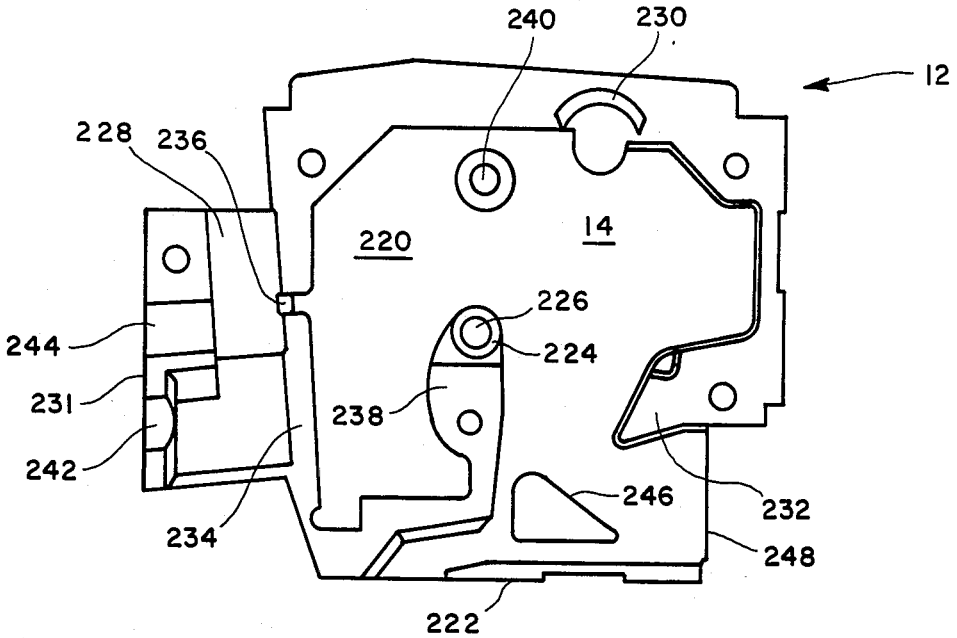
FIG. 7*b* shows the opposite side of the intermediate casing which is complimentarily received against the base.
Figure 8A:
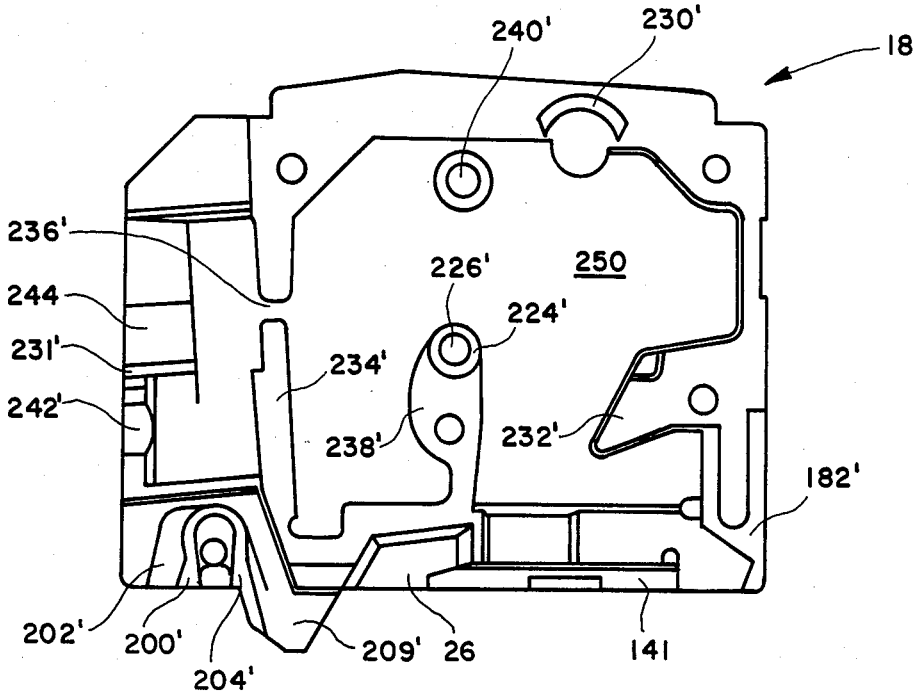
FIG. 8*a* shows the side of the cover which is complimentarily received against the intermediate casing.
Figure 8B:
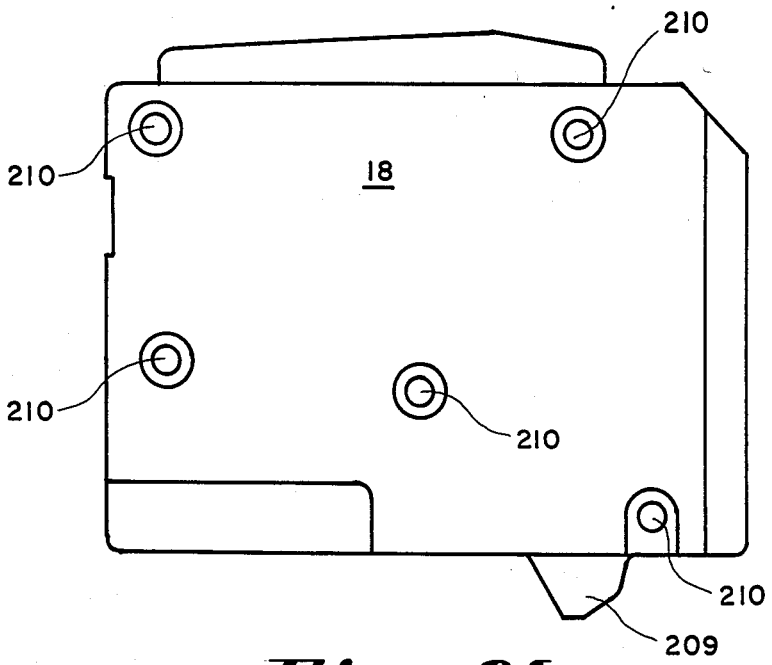
FIG. 8*b* shows the outside of the cover of the circuit breaker.
Figure 9:
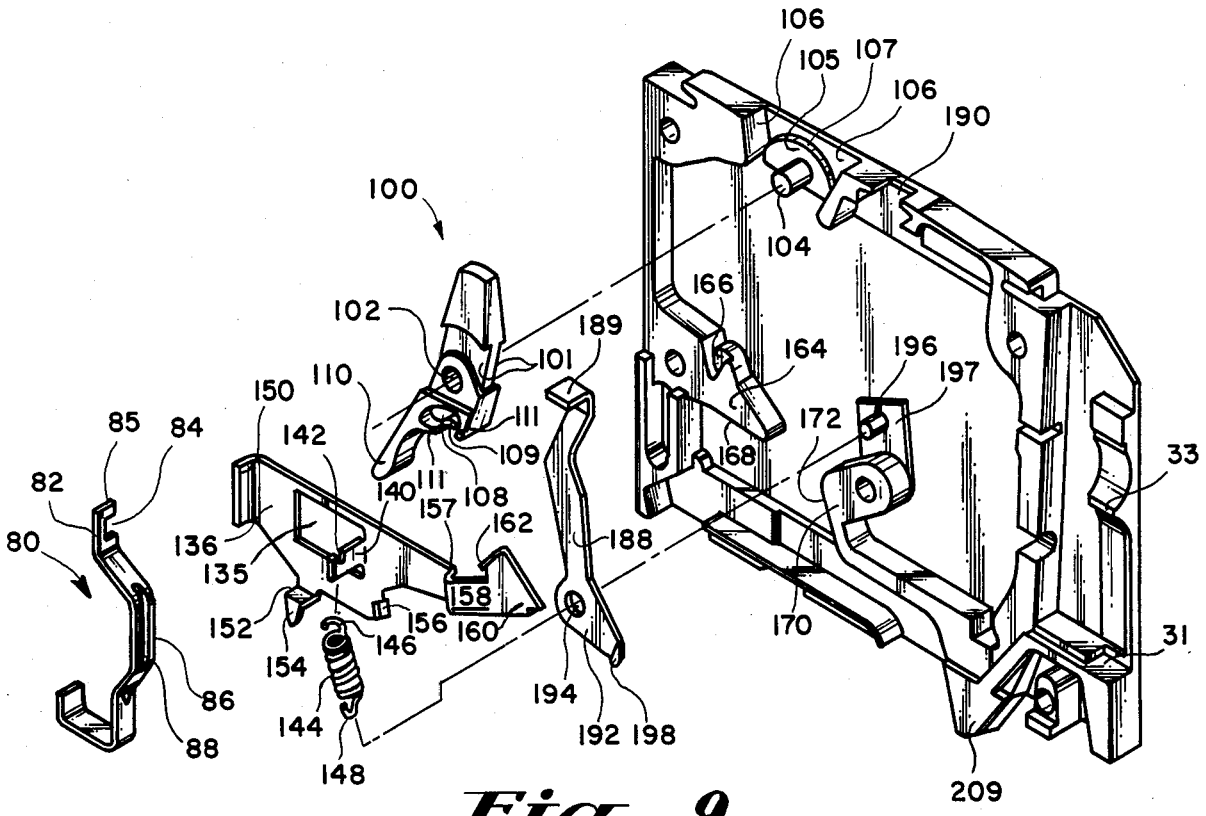
FIG. 9 is an exploded perspective view showing the base, trip lever, handle, coil spring, indicator flag and blade.

The base 10, which is shown in FIGS. 2, 6*a* and 6*b*, has an overall thickness of approximately $\frac{3}{8}$ inch. It includes a large central recess 28 on its interior side shown in FIG. 6*a* (without mechanism elements) which receives most of the circuit breaker mechanism and a laterally recessed portion 30 also on its interior side which receives a terminal lug 32 and screw 34 on the load side of the circuit breaker. A divider portion 36 is provided intermediate the central recess 28 and the lateral recess 30 with a slot 38 that receives an outwardly extending portion of a terminal strap 40 which constitutes part of the load terminal. A second and larger slot 42 is provided in the divider portion which receives an adjustment screw 44. The lateral recess is bordered at its base by a support surface 31, which facilitates positioning of the intermediate casing on the base. A rib 33 is also provided on the load side of the circuit breaker base.

A first nub 46 is provided on the divider portion which protrudes slightly into the central recess and engages one surface of the lower portion of the terminal strap where a bent portion 48 of the strap is provided. A second nub 47 is provided on the divider portion of the casing adjacent the outwardly extending portion of the terminal strap. As shown in FIGS. 2, 3, 4 and 5 the opposite surface of the lower bent portion of the terminal strap is welded to a bimetal 50 at a base portion 52 of the bimetal which narrows at its center portion to approximately ⅔ of its original width and then extends to an end 56 which is welded to a magnetic yoke 58. The yoke serves as an extension of the bimetal and since it may be formed from cold rolled steel represents cost savings as compared with using a longer bimetal. The bimetal will vary according to the rating of the breaker. For example, a 30A breaker could use a B175R bimetal, while a 20A breaker could use a B300R bimetal and a 15A breaker could use a D560R bimetal which are furnished by Tru-Flex located in Attleboro, Mass.

The terminal strap 40 acts as a bridge across the nubs 46 and 47. When adjustment screw 44 is turned clockwise it draws the terminal strap toward the lateral recess and similarly deflects the bimetal toward the lateral recess which decreases the overtemperature trip time. Energy is stored in the strap as a result of this drawing process since the strap will tend to return to its initial position. Conversely, rotation of the adjustment screw counterclockwise releases the stored energy within the terminal strap and the strap returns toward its original position moving the bimetal away from the lateral recess which increases the overtemperature trip time relative its previous position.

Figure 5:
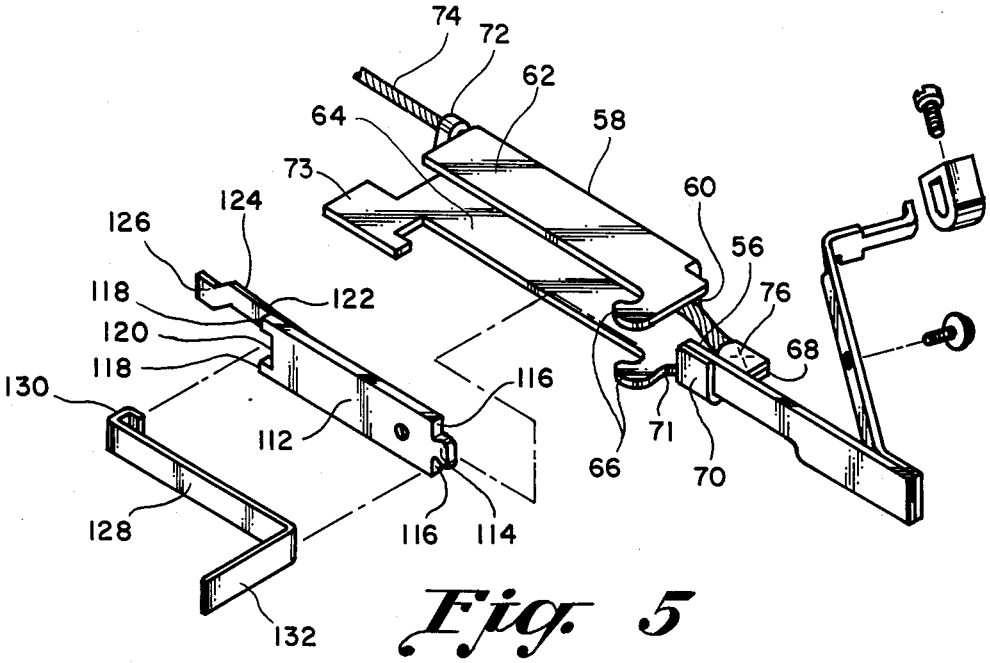
FIG. 5 is an exploded perspective view showing the load side terminal strap, bimetal and yoke assembly together with the armature, compensator and latch spring.

The generally U-shaped yoke 58 as best seen in FIG. 5 includes a back wall 60, a first side wall 62 and an opposite side wall 64. Complementary dog-leg portions 66 are provided toward the bimetal end of the yoke. While the first side wall 62 ends at the dog-leg, the opposite side wall 64 includes an extended portion 68 with tab 70 extending at right angles therefrom and away from the base 10. The tab includes an edge 71 adjacent the dog leg portions. The end 56 of bimetal 50 is welded to tab 70. At the opposite end of the yoke is an ear portion 72 which is crimped to help appropriately position braided conductor or pigtail 74. Adjacent this end of the yoke and coextensive with the opposite side wall 64 is a protruding stop tab portion surface 73. One end 76 of the pigtail is welded to the extending portion 68 of the yoke while ear 72 retains an intermediate portion of the conductor such that the conductor is positioned adjacent the back wall 60 of the yoke. The opposite end 78 of the pigtail is welded to a blade member 80.

The relatively long and narrow blade 80, which is shown in FIGS. 2, 3, 4 and 9, is formed from a generally rectangular conductor of, for example, copper alloy 220 having a small section removed from one end 82 to form a handle receiving cut-out portion 84. This small section is the only scrap from the blade material. A top segment 85 remains on the blade having a width slightly less than the width of the rest of the blade. The blade member is formed to a generally J-shaped member having an offset intermediate portion 86 that is provided with a rib/-trough formation 88 extending substantially along a central portion of offset 86 to provide increased rigidity to the blade member and serve as a trough on the back of the blade for locating the pigtail 74 for the welding operation. The blade member includes a straight segment 90 which is substantially coplanar with the one end 82. A tang 92 is formed by piercing and lansing a small section from the blade member on the obtuse side of the bend intermediate the offset portion 86 and straight segment 90. A base segment 94 extends at approximately a right angle from straight segment 90 and an upturned portion 96 at the end of the base segment carries a movable contact 98 which is welded to the blade.

A phenolic handle operating member 100 is provided with a mounting hole 102 which receives a plug 104 molded into the base 10 for rotation about the plug. The plug extends from a slightly raised surface 105 on the casing. The top portion of the handle extends through top opening 20 to allow manual operation of the circuit breaker. Opposite stop surfaces 106 on the base limit movement of the handle. A semicircular raised track portion 107 is provided on the raised surface 105 extending from one stop surface 106 to the other. The handle operating member 100 is provided with a groove 101 just above mounting hole 102 which receives the track 105. A similar groove 101 is provided on the opposite side of the handle. The opposite end of the handle member includes a kidney-shaped recess 108 which receives a portion of the top segment 85 of the blade end 82. An indented ridge 109 on the handle member forms the lower wall defining the recess 108 and is received within the cut-out portion 84 of the blade. At each end of the indented ridge 109 is a higher surface 111 which is substantially flush with the top of the blade member 80 of the top segment 85. A protuberance 110 is provided on the handle member for reasons which will be hereinafter described.

As shown in FIG. 5, armature 112 includes a tang portion 114 at one end which is received between side walls 62 and 64 with wing surfaces 116 which are received in the opening between each dog-leg portion and its respective side walls. A pair of tines 118 are provided on the armature at the end opposite the end at which the bimetal is connected to define a recessed portion 120. A bimetallic compensator member 122 is welded to the armature adjacent tang 114. The compensator extends longitudinally along the length of the armature and includes a portion 124 extending past the end of the armature having the tines 118. An offset portion 126 is provided at the free end of compensator 122 which engages the stop surface 73 of the yoke. The compensator 122 is welded to the armature 112 adjacent the tang 114 and then extends at a slight angle away from the surface of the armature. This member compensates for thermal ambient differences which would cause the bimetal 50 to move the yoke and armature toward the release position. In response to a sufficient ambient temperature increase, the compensator 122 deflects in the same manner as the bimetal which causes the armature to move away from the yoke toward the fully latched position. The armature is positioned tangent to the bowed compensator, the center of which moves toward the trip lever.

A latch spring 128 runs along the underside of armature 112 and is provided with a reverse bent portion 130 which is bent over the end of armature 112 and received between tines 118. The opposite end of latch spring 128 includes a segment 132 which extends away from the yoke assembly and engages the edge 71 of tab 70. This segment of the spring facilitates trip indication of the circuit breaker as will be later addressed.

A trip lever 134, shown in FIGS. 2, 3, 4 and 9, is formed from a thin piece of cold rolled steel and includes a generally planar main surface 136 having a generally rectangular opening 135 therein. One side of the main surface of trip lever 134 is engaged with the wall of recess 28. A tang 140 extends upward from the opposite side of main surface 136 along one side of the opening 135. The tang is provided with a notch 142 therein. A coil spring 144 is positioned with one end 146 hooked within notch 142 and the opposite end 148 hooked over the tang 92 of the blade member 80. The trip lever includes an upstanding leg 150 associated to be engaged by protuberance 110 in order to reset the breaker as will be later described. An upstanding tang 152 is provided at the base of the trip lever with a generally V-shaped pivot surface 154 extending downward from the edge of the tang in generally parallel planar relationship with the main surface 136 of the trip lever. A kicker tab 156 is provided on the trip lever and positioned intermediate coil spring 144 and the offset portion 86 of blade 80. The kicker tab 156 impacts blade 80 to counteract welding of the contacts upon tripping as well as upon opening the breaker. The trip lever also includes an offset armature retaining arm 158 which includes a tooth 160 having an ear 162 bent upward from the top of tooth 160. A shoulder 157 spaces retaining arm 158 from main surface 136 of the trip lever.

As mentioned previously, the casing 10 is provided with various molded barriers including an arc barrier 164 which has a step 166 formed to receive the V-shaped pivot surface 154 and to permit limited rotation thereof. Barrier 164 includes a shielding surface 168 which, when the contacts are separating, shield the internal mechanism from arc gases. A blade stop 170 is provided on the opposite side of the blade from arc barrier 164. Blade stop 170 includes a stop surface 172 provided to engage straight segment 90 of the blade. The stop surface is spaced from the arc barrier by a distance less than the length of the base segment 94 of the blade so that, as seen in FIGS. 3 and 4, the contacts are shielded by the arc barrier from the trip lever and coil spring.

A generally U-shaped line side contact jaw 174, which may be formed from a tin plated copper alloy 521, includes an upwardly inclined bridge section 176 with an upwardly extending segment 178 to which stationary contacts 180 are welded. The single jaw includes two stationary contacts, one positioned within each pole of the side-by-side circuit breaker. The casing is formed to provide a barrier leg 182 which is complementarily shaped to provide support for stationary contact jaw 174 most substantially along the back side of upwardly extending segment 178 and along the top surface of ridge 176. Each jaw is provided with a catch 184, the underside of which is retained by a molded segment or runner 186 formed at the bottom of the casing. An inclined portion 185 of the casing conforms to an inclined U-shaped surface 187 of the jaw 174 to cooperate with catches 184 and segment 186 to position the jaw within the casing.

A generally elongated flag member 188 is provided to indicate through a lens 190 whether the breaker is in a tripped position. The lens is located on the top face of the casing adjacent the handle. The flag member is provided with a base 192 having an opening 194 which receives a boss 196 extending from a raised peninsula 197 from the rear wall of recess 28. An inclined cam surface 198 extends from base 192 and is engaged with the opposite end 132 of the latch spring 128. The other end of the flag includes an upstanding indicator portion 189 which may be painted or otherwise designated to be noticed through the lens.

Figure 3:
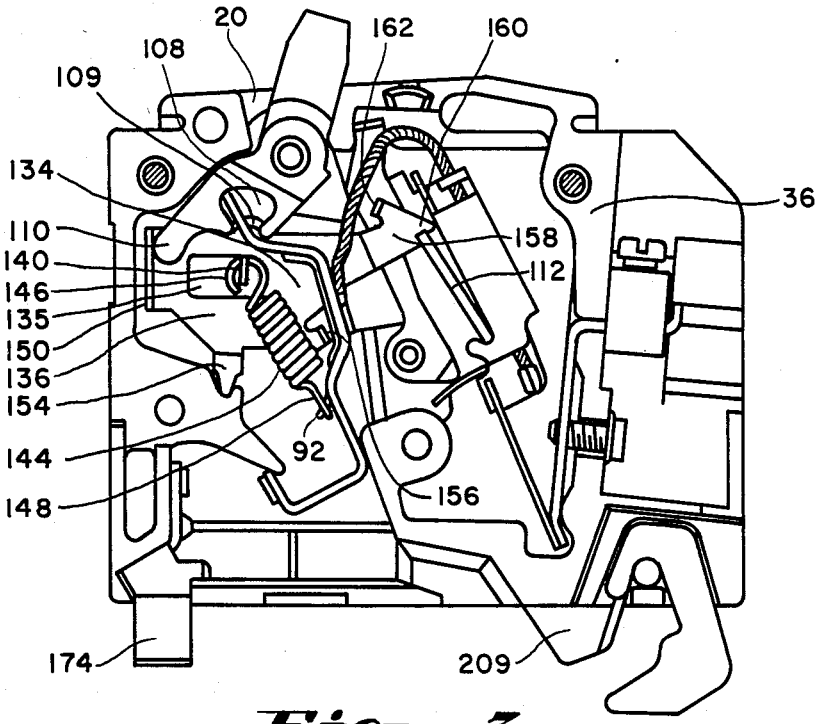
FIG. 3 is a side view as shown in FIG. 2 with the mechanism in the fully open position.
Figure 4:
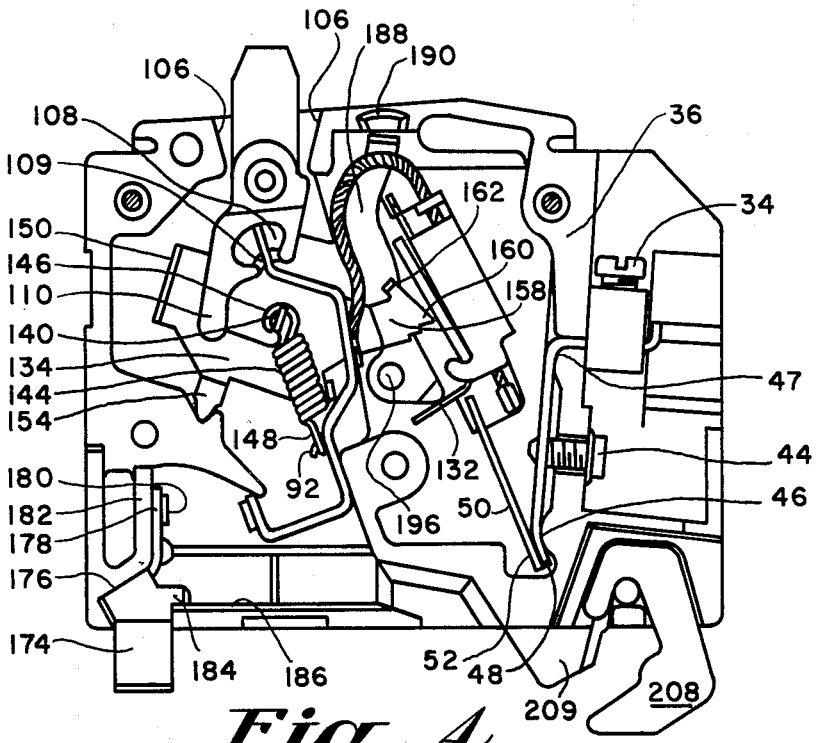
FIG. 4 is a side view as shown in FIG. 2 with the mechanism in the trip position.

When the trip lever is in the upright position as shown in FIGS. 2 and 3 wherein armature 112 retains arm 158, the shoulder 157 of the trip lever is in a first position which enables spring 128 to urge the cam surface 198 upward and rotate trip flag 188 about boss 196, positioning indicator portion 189 behind casing 10 and out of view through lens 190. When the armature releases trip arm 158, while the breaker is in the closed position, spring 144 rotates the trip lever about the pivot surface 154 positioning the trip lever in a downward position as shown in FIG. 4 which causes the shoulder 157 to urge flag 188 against the bias of spring 132 to a trip indicating position wherein indicator portion 189 is visible through the lens 190.

Just below lateral recess 30 is a load side connector casing portion which includes a double recessed portion 200 and a rejection extension 209. The double recessed portion has a first recess surface 202 and a generally horseshoe shaped groove 204 therein. Groove 204 is adapted to receive a jaw shaped mounting clip (not shown) while recess surface 202 is adapted to receive a rejection dog 208. The rejection dog cooperates with the rejection extension 209 on the casing adjacent the double recessed portion to limit the number of two pole breakers that can be used to replace single pole breakers in order to prevent overloads. Several openings 210 are provided in the casing which receive rivets or other fasteners 15 to connect each of the casings together.

FIG. 4 shows a circuit breaker mechanism in the trip position. Trip lever 134 is rotated to its downward position whereby the trip lever tooth 160 engages a mid portion of the armature 112. The handle 100 assumes a generally straight up, intermediate, position with tang 82 being located in the central portion of handle recess 108. Protuberance 110 is engaged with the lower portion of leg 150 with shoulder 159 engaging the lower portion of flag 188 adjacent the base portion 192 pushing cam portion 198 against spring 130 and positioning the indicator 189 such that it is visible through lens 190. When the handle 100 is moved to the reset position towards lens 190, protuberance 110 rides upward against bar 150 which rotates trip lever 134 on its pivot 154 to an upright and latched position such that the tooth 160 rides up against armature 112 until the armature is received within notch 161. Tang 82 of the blade 80 is now moved to the position within recess 108 towards protuberance 110. With the armature retaining the trip lever in an upright position, when the handle operator is moved to the contact closed position, the coil spring is moved to an overcenter position snapping the blade to its closed position and engaging movable contact 98 with stationary contact 180.

As can be seen in FIG. 2 the current path runs from the terminal strap 40 through bimetal 50 to yoke 58 then through pigtail 74 to contact blade 80 then through movable contact 98 and stationary contact 180 to contact jaw 174. The trip mechanism which includes the trip lever, coil spring, armature, yoke and bimetal operates to open the circuit breaker contacts in response to an overtemperature situation or in response to an instantaneous overload. The bimetal 50 senses an overcurrent condition and moves toward the terminal strap which causes the armature to release trip lever 134. In the event of an instantaneous overload, the magnetic attraction of the yoke draws the armature 112 away from tooth 160 of trip lever 134. In either event, without the tooth 160 of the trip lever being retained by the armature 112, coil spring 144 draws the trip lever to the downward position by rotating it about the pivot point 154. The trip lever tang 140 is thereby moved into the space provided by the offset portion of blade 80 which draws the blade and movable contact 98 away from stationary contact 180, positioning handle 100 in an upright intermediate position with protuberance 110 engaged with the lower portion of leg 150. Upon rotation of the trip lever, the kicker tab 156 inpacts blade 80 to assist in separating the contacts.

The intermediate casing or base cover 12, as shown in FIGS. *7a* and *7b*, includes a slightly recessed complimentary portion 220 in its first side 14 shown in FIG. *7b* which is associated with the recess 28 on base 10. Along the bottom of the intermediate casing on both sides 14 and 16 is a strip 222 which is received in a groove 191 formed in both the base and the cover. A hub 224 is provided with a centrally recessed portion 226 which receives boss 196. A lug portion 228 extends laterally outward from one side of the intermediate casing and is fittingly received over the lateral recessed area 30 of casing 10 whereby support surface 31 is engaged with the lower portion 229 of the lug portion. A rib 231 is complimentarily aligned with rib 33 on the base. An arcuate track 230 is also provided on this side 14 of the intermediate casing to be received in the groove 101 provided on the handle. The side 14 shown in FIG. *7b* is positioned in facing relationship with the base surface shown in FIG. *6a*. A corresponding arc shield portion 232 is engaged with arc shield 164 while, on the load side, a corresponding divider strip 234 is in facing relationship with divider portion 36 of the base. A passage 236 is provided in the divider strip where the terminal strap 40 transverses from the central recess to the lateral recess.

A corresponding blade stop segment 238 is provided which is in facing relationship with blade stop 170. An embossed portion 240 extends from the first side 14 of the intermediate casing which fits under the upper loop of the pigtail 74. Respective recesses 242 and 244 on the lateral portion provide access to the adjustment screw 44 and lug terminal 32. A generally triangular vent opening 246 is provided adjacent the blade stop providing for venting between separate poles of the circuit breaker. The portion of the intermediate casing 12 located by the lower portion 94 of the contact blade does not extend to the side of the circuit breaker. A side edge 248 is aligned to correspond with runner 186 and strip 222 which permits the extending segment 178 of the contact jaw to extend between poles intermediate the leg barrier 182 and the runner 186 and strip portions 222.

The opposite side 16 of the intermediate casing includes a mechanism receiving recess 320 as shown in FIG. *7a*. This side is formed substantially similar to the interior side of the base as shown in FIG. *6a* except that the side edge 248 forms the lower left perimeter adjacent the contact jaw 174 and the lug portion 228 extends outward only from the central portion of the load side of the circuit breaker without a load side connector casing portion. While this side of the intermediate casing is provided with a strip 222 and vent opening 246 it also includes a divider portion 36', slots 38' and 42' and nubs 46' and 47' as described with respect to portions of the base. Also included on this side of the intermediate casing is a slightly raised surface 105' and a plug 104' which is received in another handle member 100' as well as a raised track portion 107', opposite stop surfaces 106' and a lens 190'. As previously described with respect to the base, the intermediate casing also includes an arc barrier 164' with a step 166' for supporting the pivot 154' of a trip lever as well as a shielding surface 168', a blade stop 170' with a stop surface 172' and a raised peninsula 197' with a boss 196' which pivotally retains a trip indicating member. A load side rib 231' is provided which is similar to the rib 230 on the opposite side of the intermediate casing.

A cover casing 18 is shown in FIGS. *8a* and *8b*. The interior side shown in FIG. *8a* includes a slightly recessed complementary portion 250 which is associated with the mechanism receiving recess 320 of the intermediate casing shown in FIG. *7a*. The various formations therein are similar to the complementary side 14 of intermediate casing shown in FIG. *7b*. The complementary central recess 250 is provided with a corresponding arc shield portion 232' which engages the arc shield 164' of the intermediate casing, a corresponding blade stop segment 238' is provided in facing relationship with blade stop 170'. A hub 224' is provided with a centrally recessed portion 226' which receives boss 196'. A corresponding divider strip 234' is in facing relationship with divider portion 36' of the intermediate casing. A passage 236' is provided in the divider strip where the terminal strap transverses from the central recess to the lateral recess. An embossed portion 240' extends from the interior side of the cover casing and fits under a loop in the pigtail 74 comprising part of the electrical path. Respective recesses 242' and 244' on the lateral portion provide access to the adjustment screw 44 and lug terminal 32 which are provided on the circuit breaker while a rib 231' is provided intermediate the respective recesses for complementary association with the rib 231' of the intermediate casing. The casing cover, like the casing base is provided with retention and rejection means comprising a double recessed portion 200' and a rejection extension 209'. The double recessed portion has a first recess surface 202' and a generally horseshoe shaped groove 204' therein. These portions are complementarily associated with their respective cooperating portions of the base to retain mounting clips and/or a rejection dog 208 as previously described with respect to the base casing. A barrier leg 182' which takes the form of a generally U-shaped molding, is complementarily received against the barrier leg of the case and, as described, provides support for the stationary contact jaw 174 which extends across both poles. As shown in FIG. 1, the base, intermediate and cover casings are complementarily associated and connected together by screws 15, rivets or the like. The casing has an overall thickness of substantially $\frac{3}{4}$ inch wherein separate, side by side, circuit breaker mechanisms are provided in their respective compartments formed by the casing members.

While the invention has particularly been shown and described with reference to a preferred embodiment, it will be understood by those skilled in the art that variations in form, construction and arrangements may be made therein without departing from the spirit and scope of the invention, all such variations are intended to be covered in the appended claims.

What we claim is:

1. An automatic electric circuit breaker having a molded casing formed with barriers and recesses therein, a line terminal, a load terminal electrically connected to said line terminal, a stationary contact in said casing intermediate said line terminal and said load terminal, a movable blade within said casing having one end and an opposite end, a movable contact mounted on said one end of said blade and movable thereby into and out of engagement with said stationary contact, a releasably latchable generally flat, thin trip lever pivotally mounted in said casing and releasable from a latched position for movement to a tripped position to effect separation of said contacts, an armature releasably latching said trip lever in said latched position and movable to release said trip lever enabling said trip lever to move to said tripped position, a yoke carrying said armature and operably associated therewith to attract said armature to release said trip lever, said yoke connected to said load side terminal, a handle pivotally supported within and extending beyond said casing, said opposite end of said blade connected to said handle, a spring having a first end connected to said trip lever and a second end connected to said blade, said spring biasing said trip lever toward said tripped position, said trip lever including a shoulder portion adapted to be engaged by said handle to pivot said trip lever to said latched position, said handle including a protuberance extending from one end thereof in overlapping relationship with said trip lever and adapted to engage said shoulder portion of said trip lever to move said trip lever to said latched position.

2. An automatic electric circuit breaker as claimed in claim 1 wherein said trip lever includes a central main surface having portions defining a generally rectangular opening therein, a tang extending upward from said main surface, a notch formed in said tang and said spring connected at its one end within said notch.

3. An automatic electric circuit breaker as claimed in claim 2 wherein said trip lever includes a base portion, an upstanding tang provided at said base portion, a generally V-shaped pivot surface extending from said tang in generally parallel relationship with said main surface of said trip lever for pivotal retention within said casing.

4. An automatic electric circuit breaker as claimed in claim 3 including a kicker tab extending upward from said trip lever intermediate said coil spring and said blade for impacting said blade in response to said trip lever to facilitate separation of said contacts.

5. An automatic electric circuit breaker as claimed in claim 3 wherein said trip lever includes an offset armature retaining arm, a shoulder portion connecting said retaining arm to said main surface, said retaining arm including a tooth portion, said armature engaged with said tooth portion to retain said trip lever in said latched position and movable to a second position out of engagement with said tooth to release said trip lever to effect separation of said contacts.

6. An automatic electric circuit breaker as claimed in claim 5 wherein said yoke comprises a generally U-shaped member having a back wall, a first side wall and an opposite side wall, said opposite side wall including an extended portion at one end and having a tab extending at substantially a right angle therefrom for connection to a bimetalic element, said yoke including an ear portion at the opposite end of said yoke, said pigtail connected to said extended portion and extending along the back wall of said yoke and retained adjacent the back wall of said yoke by said ear portion.

7. An automatic electric circuit breaker as claimed in claim 6 wherein said armature includes one end pivotally connected with said yoke and an opposite end including a pair of spaced apart tines, a compensator member having a fixed end connected to said one end of said armature intermediate said armature and said back wall of the yoke, said compensator member extending longitudinally along the length of said armature and having a free end extending past said armature, said free end including an offset portion engaged with said stop tab portion of said yoke.

8. An automatic electric circuit breaker as claimed in claim 7 including a latch spring extending along the underside of said armature, said latch spring including a reverse bent portion extending between said tines of said armature, said opposite end of said latch spring including a segment extending away from said yoke assembly and engaging a side portion of said tab extending from said yoke.

9. An automatic electric circuit breaker having an insulating casing, a stationary contact within said casing, a movable blade carried within said casing, a movable contact mounted at a first end of said blade, an operating handle pivotally supported within said casing and extending outward therefrom, said handle manually movable from a first position corresponding to a closed circuit to a second position corresponding to an open circuit, an opposite end of said blade connected to said operating handle, a trip lever pivotally mounted within said casing and movable between a latched position and a tripped position, a current responsive mechanism operably associated with said trip lever comprising a bimetal, a yoke connected to said bimetal, and an armature pivotally associated with said yoke and attracted to said yoke in response to the passage of a predetermined level of electric current through said yoke, said armature operably associated with said trip lever to retain said trip lever in said latched position and release said trip lever in response to a predetermined overtemperature or overcurrent condition, a spring having one end connected to said trip lever and an opposite end connected to said blade, said trip lever comprising a relatively thin, flat main body portion positioned against said casing and having a shoulder portion extending upward from said main body portion, said handle including a protruding portion in overlapping relationship with said main body portion and operably associated with said shoulder portion to facilitate engagement of said shoulder portion by said protruding portion of said handle in response to movement of said handle from said second position to said first position to effect movement of said trip lever to said latched position.

10. An automatic electric circuit breaker having an open sided base casing formed of molded insulating material with recesses and barriers, said base casing including a main recess partially defined by a rear wall for support of a mechanism therein, a load terminal, a line terminal serially connected to said load terminal, a mechanism, a handle operably connected to said mechanism, said mechanism comprising:

a bimetal connected to said load terminal, a yoke connected to said bimetal, an armature operably associated with said yoke, a blade electrically connected to said yoke, a contact connected to a first end of said blade, the opposite end of said blade operably connected to said handle, a trip lever having a thin main body portion engaged with said rear wall, said trip lever movable between a latched position and an unlatched position with respect to said armature, said trip lever further including a base portion having a pivot surface, said trip lever being pivotally supported within said base casing, a coil spring having one end connected to said trip lever and an opposite end connected to said blade, said armature engaged with and retaining said trip lever in said latched position against the bias of said spring, said armature movable to release said trip lever in response to an overtemperature or overcurrent condition whereby said trip lever returns to said unlatched position.

11. An automatic electric circuit breaker comprising a molded case, a movable contact blade within said case, operating means for moving said blade between a first position corresponding to a closed circuit condition and a second position corresponding to an open circuit condition, overcurrent trip means for actuating said operating means to move said blade from said first position to said second position, said operating means including a pivotable trip lever retained in a first position in response to said blade being in said first position and movable to a second position in response to the release of said trip lever in response to a predetermined overcurrent condition to effect movement of said blade from said first position to said second position, said overcurrent trip means including a generally U-shaped yoke within said casing, and an operably associated armature for retaining said trip lever in said first position and for releasing said trip lever in response to a predetermined overcurrent condition, said yoke including a back wall, a first side wall and an opposite side wall, said opposite side wall including an extended portion at one end of said yoke, a tab extending at substantially a right angle from said extended portion in generally parallel planar relationship with said back wall, retaining means adjacent the opposite end of said yoke for retaining a flexible electrical connector, a flexible electrical connector connected to said extended portion of said yoke and extending along said back wall of said yoke and retained along said back wall by said retaining means, said flexible electrical connector connected at its opposite end to said contact blade.

12. An automatic electric two-pole circuit breaker comprising an insulating base casing having a central recess for receiving a circuit breaker mechanism, an intermediate insulating casing having a first side complementarily associated with said base casing and forming a first compartment between said base casing and said intermediate casing, said intermediate casing having a second side including a second central recess for receiving a circuit breaker mechanism, a cover having a first side complementarily associated with said second side of said intermediate casing and forming a second compartment between said intermediate casing and said cover, said first compartment and said second compartment each including the following: a pivotally supported operating handle extending partially outward from said casing for external manual operation, a line terminal, a load terminal electrically connected to said line terminal, a stationary contact intermediate said line terminal and said load terminal, a movable blade having one end and an opposite end, a movable contact mounted on said one end of said blade and engaged with said stationary contact and movable out of engagement with said stationary contact to break said electrical connection, a releasably latched trip lever pivotally mounted within said compartment and releasable from a latched position for movement to a trip position to effect separation of said contacts, an armature releasably latching said trip lever in said latched position and movable to release said trip lever enabling said trip lever to move to said tripped position, a yoke operably associated with said armature to attract said armature to release said trip lever, said yoke connected to said load side terminal, said opposite end of said blade connected to said handle, a flexible electrical connector having a first end connected to said blade and an opposite end connected to said yoke, a spring having a first end connected to said trip lever and a second end connected to said blade, said spring biasing said trip lever toward said tripped position.

13. An automatic electric circuit breaker as claimed in claim 12 including a trip indicator pivotally mounted within each said compartment, said base casing and said intermediate casing each having a lens provided through which indicia can be identified, said trip indicator including a first end having identifying indicia thereon and an opposite end including a cam surface, a latch spring biasing said indicator to a first position wherein said indicia is not visible through said lens, said trip lever including a shoulder portion engaging said indicator which moves said indicator to a second position through which said indicia is visible through said lens in response to said trip lever moving to said tripped position.

14. An automatic electric circuit breaker as claimed in claim 12, wherein said line terminal comprises a generally U-shaped contact jaw having an upwardly extending segment traversing said first compartment and said second compartment and carrying one of said stationary contacts in each said compartment.

15. An automatic electric circuit breaker comprising: an insulating base casing having a main recess, a stationary contact carried in said recess, a movable blade having one end and an opposite end in said recess, a movable contact mounted on said one end of said blade and movable thereby to a first position in engagement with said stationary contact and to a second position along a predetermined path out of engagement with said stationary contact, interruption means for interrupting said circuit in response to a predetermined overcurrent condition, said interruption means including a trip lever, and a spring connecting said movable contact blade with said trip lever, said insulating base including an integrally molded arc shield extending into said central recess in overhanging relationship with respect to said stationary contact, said arc shield extending into said recess substantially adjacent said path between said first position and said second position of said movable contact and intermediate said contacts and said trip lever and spring whereby said shield provides protection to said interrupting means from arc gases which may be generated from separation of said contacts.

16. An automatic electric circuit breaker as claimed in claim 14 wherein said base casing further includes an integrally molded blade stop, said movable blade extending intermediate said arc shield and said blade stop, said blade stop positioned to permit movement of said blade to a position wherein said movable contact is positioned adjacent said arc shield.

17. An automatic electric circuit breaker comprising: a casing:

a stationary contact in said casing;
a movable contact blade in said casing;
a movable contact mounted on said blade and movable thereby into and out of engagement with said stationary contact;
a releasably latchable trip lever pivotally mounted in said housing and releasable from a latched position for movement to a tripped position to effect separation of said contacts;
a handle pivotally supported within said casing having a top portion extending out of said casing for manual operation to effect movement of said movable contact into and out of engagement with said stationary contact and having an opposite end extending within said casing;
said opposite end of said handle including portions defining a recess to receive a portion of said movable contact blade;
said movable contact blade comprising a generally J-shaped member including a top portion, a base portion and an intermediate portion, said top portion including a cutout section providing an extending top segment, said extending segment received within said recess.

18. An automatic electric circuit breaker comprising:
a casing;
a stationary contact in said casing;
a movable contact blade in said housing;
a movable contact mounted on said blade and movable thereby into and out of engagement with said stationary contact;
a releasably latchable trip lever pivotally mounted in said housing and releasable from a latched position for movement to a tripped position to effect separation of said contacts;
a handle pivotally supported within said casing having a top portion extending out of said casing for manual operation to effect movement of said movable contact into and out of engagement with said stationary contact and having an opposite end extending within said casing;
a lens provided on said casing through which indicia can be identified;
a trip indicator pivotally mounted within said casing having a first end with identifying indicia thereon and an opposite end including a cam surface, a spring member biasing said indicator to a first position wherein said indicia is not visible through said lens, said trip lever including a shoulder portion engaging said indicator which moves said indicator to a second position wherein said indicia is visible through said lens in response to said trip lever moving to said tripped position.

19. An automatic electric circuit breaker comprising:
a casing;
a load terminal carried by said casing;
a line terminal carried by said casing;
a stationary contact in said casing;
a movable contact blade in said housing;
a movable contact mounted on said blade and movable thereby into and out of engagement with said stationary contact;
a releasably latchable trip lever pivotally mounted in said housing and releasable from a latched position for movement to a tripped position to effect separation of said contacts;
a handle pivotally supported within said casing having a top portion extending out of said casing for manual operation to effect movement of said movable contact into and out of engagement with said stationary contact;
said movable contact blade connected to said handle,
a bimetal connected to said load terminal and extending toward said trip lever;
a yoke connected to said bimetal and further extending toward said trip lever;
an armature carried by said yoke, said armature retaining said trip lever in said latched position.

20. An automatic electric circuit breaker as claimed in claim 19 wherein said bimetal includes a first half and a second half, said first half having a predetermined width and said second half having a width of approximately two thirds said predetermined width, said second half connected to said yoke.

21. An automatic circuit breaker comprising a casing having an integral recess formed therein;
a stationary contact carried within said recess;
a generally J-shaped movable contact blade carried in said recess;
a movable contact mounted on said blade and movable thereby into and out of engagement with said stationary contact;
a releasably latchable trip lever pivotally mounted inside said housing and releasable from a latched position for movement to a tripped position to effect separation of said contacts;
a handle pivotally supported within said recess having a top portion extending out of said casing for manual operation to effect movement of said movable contact into and out of engagement with said stationary contact;
said movable contact blade including a top portion connected to said handle, a base portion which carries said movable contact and an intermediate portion therebetween, said casing including an integrally formed arc barrier which extends into said recess adjacent said movable contact and intermediate said contact and said trip lever.

22. An automatic electric circuit breaker as claimed in claim 21 wherein said casing includes an integrally formed blade stop spaced a predetermined distance from said arc barrier, said movable contact blade extending between said arc barrier and said blade stop.

23. An automatic electric circuit breaker as claimed in claim 22 wherein said movable contact blade includes a base segment extending at approximately a right angle from said intermediate segment, and an upturned portion extending from said base segment, said base segment having a length exceeding said predetermined distance between said arc shield and said blade stop.

24. An automatic electric circuit breaker comprising:
a casing having an integrally formed recess therein;
a stationary contact in said casing;
a movable contact blade in said casing;
a movable contact mounted on said blade and movable thereby into and out of engagement with said stationary contact;
a releasably latchable trip lever pivotally mounted in said housing and releasable from a latched position for movement to a tripped position to effect separation of said contacts;
a handle pivotally supported within said casing having a top portion extending out of said casing for manual operation to effect movement of said movable contact into and out of engagement with said stationary contact and having an opposite end extending within said casing;

said casing including a pair of integrally formed stop surfaces on opposite sides of the top portion of said handle;

a semi-circular raised track portion on said casing extending between said stop surfaces; and said handle including a groove receiving said track portion.

* * * * *